US005236099A

United States Patent [19]

Fties et al.

[11] Patent Number: 5,236,099

[45] Date of Patent: Aug. 17, 1993

[54] PLASTIC KNOCKDOWN BIN-PALLET FOR LOADING, TRANSPORTING AND STORING FRUITS, VEGETABLES, FISH OR OTHER FOODS

[76] Inventors: Youssef A. Fties, 2000 W. Lincoln #11, Yakima, Wash. 98902; John J. Sandlin, 2301 Houghton Rd., Zillah, Wash. 98953

[21] Appl. No.: 932,080

[22] Filed: Aug. 19, 1992

[51] Int. Cl.[5] ..... B65D 27/00

[52] U.S. Cl. ..... 220/4.31; 220/4.33

[58] Field of Search ..... 220/4.31, 4.33, 4.34, 220/1.5; 206/600

[56] References Cited

U.S. PATENT DOCUMENTS

| | | | |
|---|---|---|---|
| 1,692,765 | 11/1928 | Salt | 220/4.33 |
| 1,932,773 | 10/1933 | Eschenbach | 220/4.33 |
| 3,266,656 | 8/1966 | Kridle | 220/4.33 X |
| 3,401,814 | 9/1968 | Chiswell et al. | 220/1.5 X |
| 4,266,670 | 5/1981 | Mykleby | 206/600 |
| 4,366,905 | 1/1983 | Forshee | 220/1.5 X |
| 4,809,851 | 3/1989 | Oestreich, Jr. et al. | 220/4.31 X |
| 4,989,731 | 2/1991 | Shuert | 206/600 X |

*Primary Examiner*—Steven M. Pollard
*Attorney, Agent, or Firm*—Roy E. Mattern, Jr.

[57] ABSTRACT

A plastic knockdown, stackable bin-pallet for loading, transporting and storing fruits, vegetables, fish, or other foods is composed of five major components readily assembled and disassembled, after their initial manufacturing, by using their respective interfitting structures, and without using tools or fasteners. When assembled, an open top bin is ready for loading, transporting, and storing, while containing fruits, vegetables, fish, or other food products. When emptied, the five major knockdown components are completely separated, cleaned, and then consolidated, to occupy a comparatively small volume, in contrast to the larger receiving volume of the assembled bin-pallet,, during their handling, storage, and transport, when emptied. These F.D.A. approved strong plastic bin-pallets are: easily cleaned; do not draw moisture out of the stored fruits, vegetables, fish or other food products; do not damage easily; are modularly replaceable in respect to a respective damaged component of the overall five major components, as other components remain undamaged; and are transported by truck or other carriers at much lower overall costs to the places where they are to be filled with fruit, vegetables, fish or other food products. In warehouses and elsewhere, when loaded and stacked, they are stacked to at least the same heights as loaded wood bins, which hold comparable volumes of fruit, vegetables, fish, or other food products.

6 Claims, 2 Drawing Sheets

FIG. 3
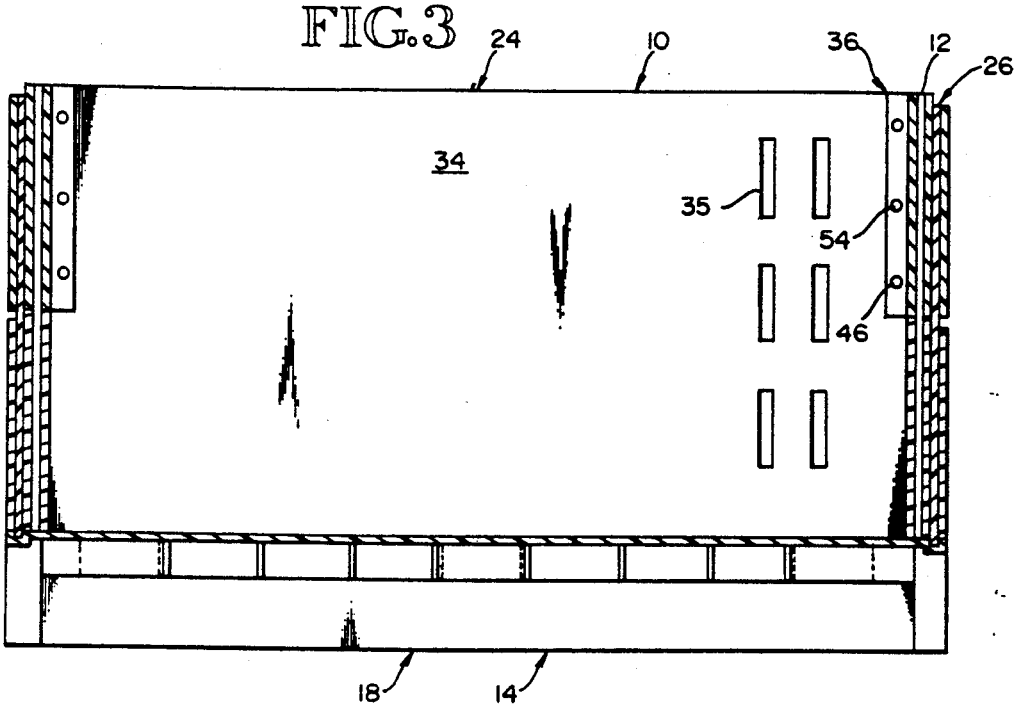
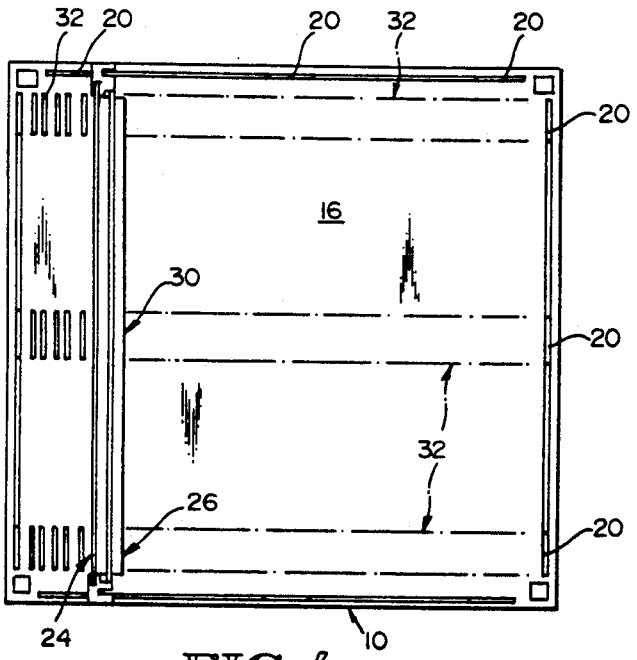
FIG. 4
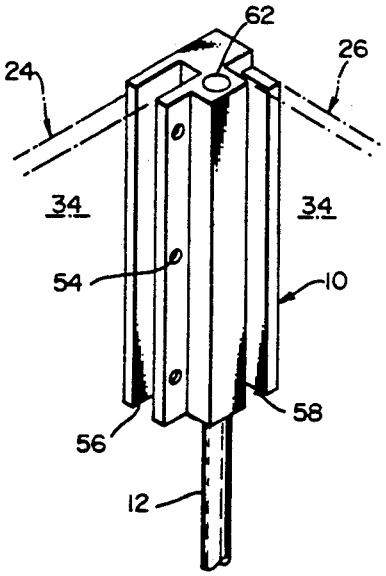
FIG. 6
FIG. 5
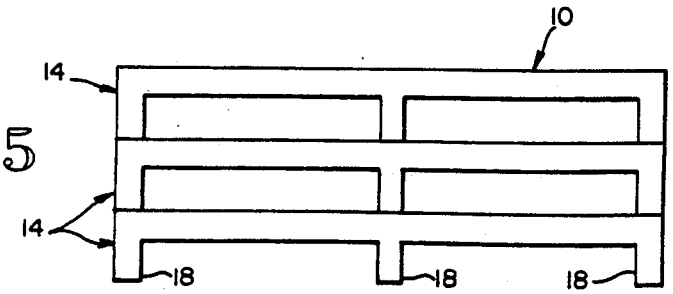

PLASTIC KNOCKDOWN BIN-PALLET FOR LOADING, TRANSPORTING AND STORING FRUITS, VEGETABLES, FISH OR OTHER FOODS

BACKGROUND

When apples or other fruits, and/or vegetables, and/or fish, and/or other foods, are stored in controlled atmosphere warehouses or cold storage, they are generally stored in wooden bins in the United States. These wooden bins have a tendency to draw down moisture from the fruits or vegetables or other foods. The most accurate measurement of these moisture losses is seven (7%) percent in the apple industry. Thus, an apple grower who has a 10,000 bin apple crop is expected, in reference to reduced volume and/or reduced weight, to lose 700 bins of apples as a result of moisture loss. When growers realize between $150.00 to $200.00 per bin net return, this constitutes a loss per 10,000 bins of approximately $140,000.00. Another problem resulting, when using wooden bins is their damage through normal operations in the orchard or warehouse environments. When a wooden bin is damaged it must be either discarded or sent to a jobber for repair. The user either loses the bin and its value, or loses the benefit of its use during a repair time.

Wooden bins also facilitate the growth of mold, bacteria and other fruit and vegetable diseases which accelerate spoilage of the food products being transported and stored.

When warehouses transport wooden bins to the growers, the grower is charged all transportation costs. These wooden bins are not collapsible and as a result multiple trips from the warehouse to the orchards or other agricultural producers' fields are required. This transportation cost is a fixed cost of production, which must be absorbed by the grower, as fruit and vegetable prices historically have been relatively stable for the past twenty years. Therefore there is a need to overcome some or all of these problems by improving bins used in handling, loading, transporting, and storing, vegetables, fruits, and other foods.

It is understood, a plastic container or bin is available for use which is not specifically designed for pallet handling and other handling equipment and handling techniques associated with handling wooden bins. Also this plastic container is stackable only to two bins in height, and cannot be knocked down. It may have a smaller receiving volume than the wooden bins.

SUMMARY

To provide for the improved handling, loading, transporting, and storing of vegetables, fruits, fish, or other foods in bins, and to provide for the improved handling, cleaning, transporting, and storing of empty bins, an F.D.A. approved plastic bin-pallet composed of five major components is provided, to be completely compatible with all present handling techniques and present equipment used in handling wood bins. These major components, after their initial manufacture, are readily assembled and disassembled, without tools and fasteners, by using their respective interfitting structures.

When assembly is completed, an open top plastic bin-pallet is ready for loading, transporting, and storing, fruits, vegetables, fish or other foods. When unloaded and disassembly is completed, the plastic knockdown bin-pallet is ready for cleaning, and then consolidation into a smaller volume.

The resulting advantages are:

a. Minimum or no loss of moisture in the fruit, vegetables, fish, or other foods as a result of no moisture withdrawal from the food to the plastic bin, in contrast to the moisture withdrawal from food and then into the wood of a wood bin;

b. Nominal or nonexistent spoilage loss of fruits, vegetables, fish or other foods because the plastic bins are easily cleaned and made safe and free from mold, bacteria or other diseases which promote accelerated food spoilage losses;

c. Lighter weight of strong plastic bin-pallets, in contrast to heavier wooden bins, offers less difficulty in handling, reduces transportation costs, and overall costs of production;

d. Plastic bin-pallets are constructed of interfitted removable components, assembled and disassembled without using tools or fasteners, rather than made as a unitary design component, thus enabling the user to replace one or more damaged components and continue to use the bin fitted with the replaced component or components, without delay;

e. All damaged F.D.A. approved plastic components are easily recyclable, promoting a non-hazardous, waste-free environment, thereby following ecologically sound principles;

f. The use of these plastic bin-pallets, which are componentized, and consolidated, when not in use, into a smaller volume, dramatically reduces storage costs, transportation costs, and storage space allocations costs;

g. The strength and rigidity of these plastic bin-pallets insures a higher safety margin during their bin-pallet usage, than when using wooden bins;

h. The plastic bin-pallet has no sharp edges which would otherwise tend to damage the fruit, vegetables, fish or other foods; and i. The ventilated plastic componentized bin-pallets allow ethylene gas to escape and be purged from the storage facility, thus insuring longer shelf life of stored fruits, vegetables, fish, or other foods.

DRAWINGS

The five major component, knockdown, stackable, plastic bin-pallet for loading, transporting and storing fruits, vegetables, fish, or other foods, is illustrated in the drawings, wherein:

FIG. 1 is an isometric view of the assembled plastic bin-pallet;

FIG. 2 is a partial exploded isometric view of this plastic bin-pallet, showing the base component having the pallet structure, one female side component, and one male side component, the interfitting female and male steel rod reinforced plastic corner posts, and the optional midpoint steel rod reinforcement assemblies, which are all being positioned for ready initial assembly, using fasteners and some tools, and then after preassembling, being finally assembled without using tools or fasteners;

FIG. 3 is a cross-sectional view taken along line 3—3 of FIG. 1, showing the assembly of some of the components, illustrated in FIG. 2, and another female side component;

FIG. 4 is a top view of the base component having the pallet structures, and also having spaced receiving slots to receive the depending insertable tongues of respective female and male side components in both their in use side wall positions, and later in their vertical spaced side by side positions, when consolidated with other side components for storage; and FIG. 5 is a side view of how the base components having pallet structures are stored, except for those base components used to receive the spaced, side by side, female and male side components in their stored positions, as shown in FIG. 4; and FIG. 6 is a partial isometric enlarged view of a top corner location of an assembled plastic bin, with the phantom lines indicating the side components.

DESCRIPTION OF THE PREFERRED EMBODIMENT

Introduction

The five major component plastic knockdown, stackable bin-pallet 10, used for loading, transporting, and storing, fruits, vegetables, fish, or other foods, which, after a first manufacturing assembly, is easily assembled and disassembled without using tools and fasteners, is illustrated throughout the figures of the drawings in a preferred embodiment 10.

The overall design in respect to size, contours, and strength, insures this plastic bin-pallet 10 will be handled in the same ways wood bin-pallets are being currently handled in the fruit industry and elsewhere today. Plus additional ways of handling are provided by designing this plastic bin-pallet 10 to be knocked-down for consolidation, in reference: to post and/or pre-season cleaning or anytime cleaning; to pre-season, post-season and during the season lower cost transport to fruit farms or ranches, or other food growing locales; to quick repairs by convenient part replacements at all times; and to lower storage and handling costs during the off-season.

The utilization of plastic and the contours thereof aid: in the cleaning processes to protect the fruit and other foods; in the loading processes by reducing the potential of bruising the fruit and other foods against the bin-pallet; and in not withdrawing moisture from the fruit and other foods, in contrast to how the wood of wood bin-pallets withdraws moisture from the fruit and other foods, with the resulting losses of value of the fruit products and other food products. Also the plastic used is approved by the U.S. Federal Food and Drug Administration, referred to as the F.D.A., in reference to protecting the food. Moreover, the plastic components, when damaged, are recycled in reclaiming processes.

Even though this plastic bin-pallet 10 is essentially referred to as being plastic, stainless steel rods 12, are utilized at selected locations as direct plastic column or plastic post load carrying metal reinforcing rods 12. By incorporating these metal rods 12, the stacking capability of these plastic, knockdown, stackable, bin-pallets 10 is enhanced to match the stacking capability of the wood bin-pallets.

The Plastic Base Major Component

Figure 1:
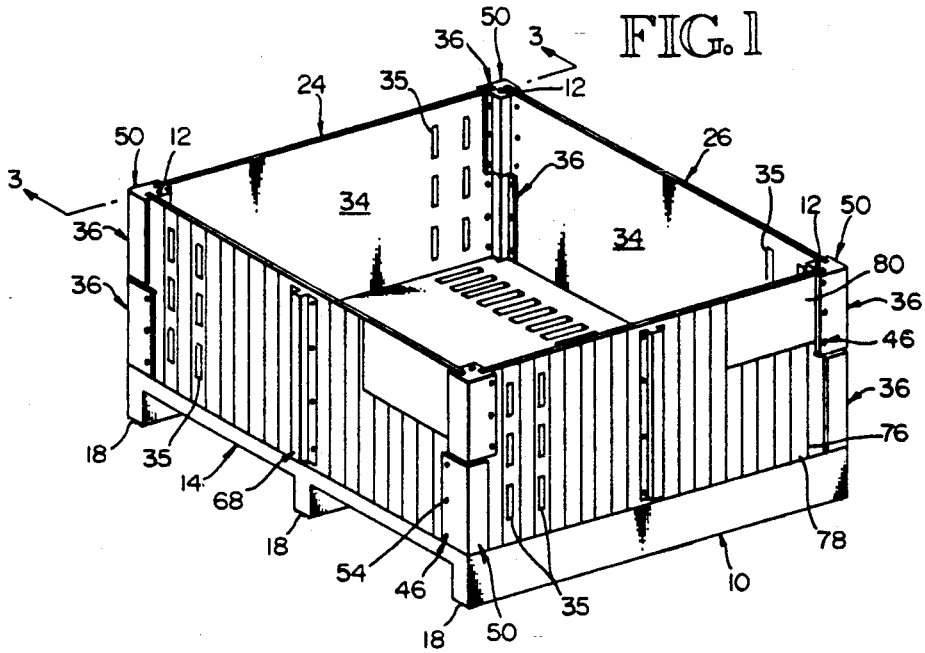

The assembled plastic knockdown stackable bin-pallet 10, in the preferred embodiment is illustrated in FIG. 1. Then in the exploded view of FIG. 2, some of the components thereof are shown in their preassembly relative locations. In this FIG. 2, the plastic base component 14, one of the five major components, is particularly illustrated. All the portions thereof are integrally manufactured. A strong planar base portion 16, has spaced, underlying, depending, three parallel reinforcement supporting leg or runner portions 18, which are arranged to receive the lifting tongues of a forklift. Also this planar base portion 16 and the reinforcement portions 18, to the extent as necessary, of this plastic base component 14 are equipped with female receiving structures 20, spaced about sides or edges thereof. Subsequently, during assembly of this plastic bin-pallet 10, male depending tongue structures 28 of plastic side male components 24, or of plastic side female components 26, are inserted into these female receiving structures 20 of this base component 14.

After an assembled plastic bin-pallet 10, has been utilized to load, transport, and store fruit, vegetables, fish or other foods, and the disassembly time arrives for cleaning, transporting, and storing, then this base component 14 may be later utilized to receive and to hold upright a number of plastic side male and female components 24, 26, each of which have spaced male depending tongue structures 28. This optional storage and transport positioning of these side male and female components 24, 26, across the planar base portion 16, is illustrated in FIG. 4, utilizing spaced, parallel multiple groups 30 of three female receiving structures 32, of like size to the female receiving structures 20 arranged about the sides or edges of this plastic base component 14.

The Four Plastic Side Major Components, Male and Female

Figure 2:
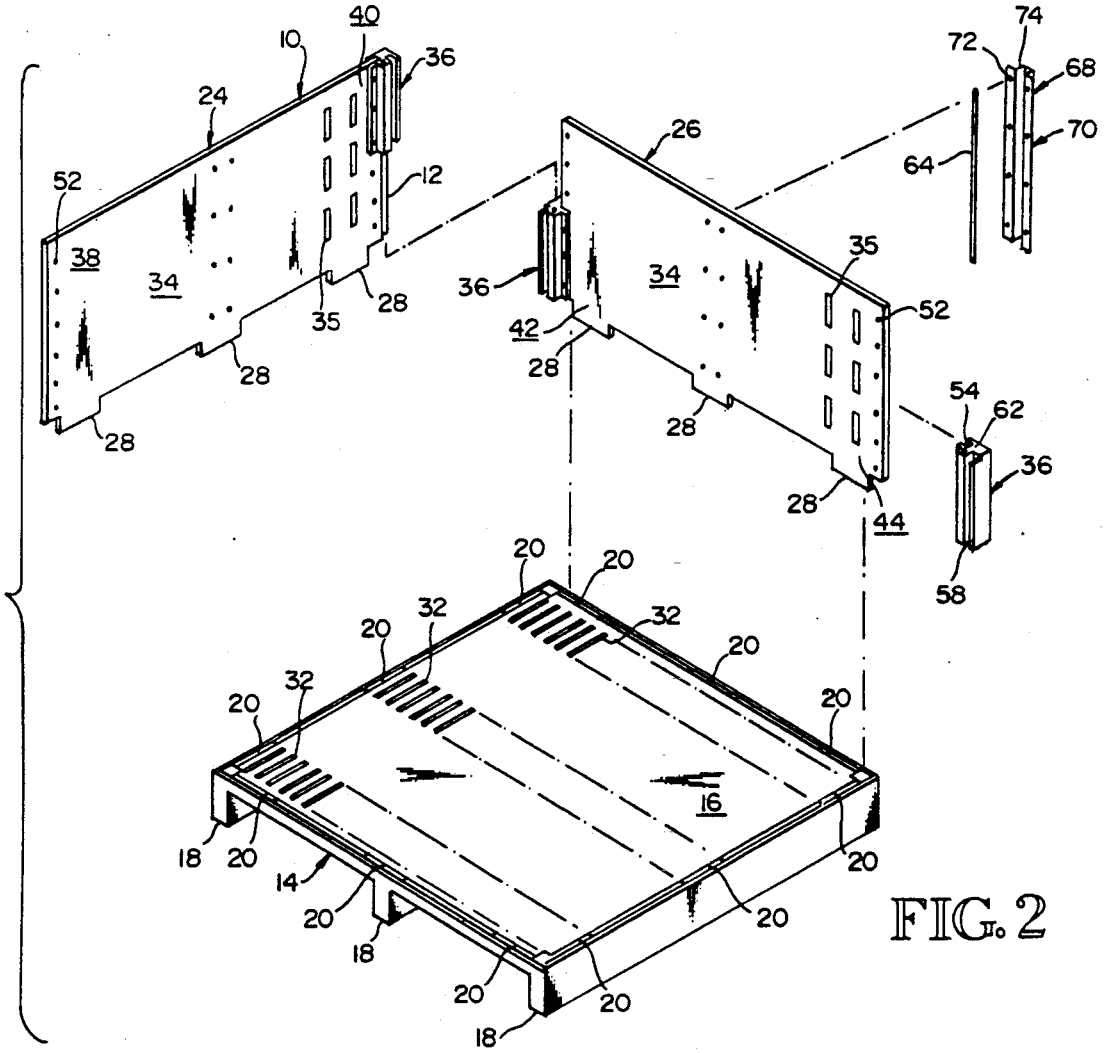

The four plastic side major components 24, 26 are illustrated, as assembled, in FIG. 1, and one male 24 and one female 26 configuration of these side components are shown in FIG. 2, prior to their assemblies. The basic planar side portion 34, also referred to as a wall portion 34 of each side component 24, 26, is alike. Each wall portion has spaced male depending tongue structures 28 arranged to enter some of the female receiving structures 20, which are spaced about the sides or edges of the base component 14.

Preferably, each of these four plastic side major components 24, 26, in their respective basic planar side portion 34, have an arrangement of spaced vertically elongated slots, serving as vents 35. These vents permit the circulation of air, and especially the exiting of any ethylene gas that may be generated during storage periods of the foods in these plastic knockdown, stackable, bin-pallets 10.

Each plastic side male component 24 is equipped with two of the eight plastic corner post structures 36, at the respective left and right top side portions thereof 38, 40. Also each plastic side female component 26 is equipped with two of the eight plastic corner post structures 36, at the respective left and right bottom side portions thereof, 42, 44.

Metal fastening assemblies 46 are used to secure these corner post structures 36 for only one half of the depth of each planar wall portion 34. After assembly of this plastic bin-pallet 10, the eight corner post structures become four respective corner columns 50.

The Eight Plastic Corner Post Structures Respectively Secured to the Respective Side Male and Female Components As particularly illustrated in FIG. 6, each plastic corner post structure 36 has fastener receiving holes 52 to match fastener receiving holes 54 in the side components 24, 26, to receive the metal fastening assemblies 46. Also each plastic corner post structure 36 has two full length receiving grooves 56, 58, orientated at right angles to one another, with each one of these receiving grooves 56, 58, being fitted, eventually, about either a respective top side portion 38, 40, edge thereof, or a respective bottom side portion 42, 44, edge thereof, of the respective side male and female components 24, 26. Also each plastic corner post structure 36 has a central receiving hole 62 to receive a respective one half length of one of four metal reinforcing rods 12. These metal reinforcing rods 12, preferably are made of stainless steel. Also preferably, they are secured to remain with the plastic corner post structures 36, which are in turn secured to the plastic side male components 24, i.e. to the planar side or wall portions thereof 34.

The Utilization of Metal Reinforcing Rods

These metal reinforcing rods 12, preferably made of stainless steel, are the length of the depth of the plastic, knockdown stackable bin-pallet 10. When positioned in the mating plastic corner post structures 36 and aligned via the aligned center receiving holes 62 of the corner post structures 36, these reinforcing rods 12 ably assist in transferring the compression loads, via the then formed four corner columns 50, when the loaded plastic knockdown stackable bin-pallets 10 are stacked up over one another to reach many levels at a storage and handling facility, such as a warehouse.

When the stacking is known to be extended to several levels, additional metal reinforcing rods 64 are positioned by utilizing reinforcing rod assemblies 68. These assemblies 68 are vertically centered and secured on each plastic side male component 24 and on each plastic side female component 26, on the exterior sides thereof, as illustrated in FIGS. 1 and 2. Each of these assemblies 68 have a plastic rod housing 70, with holes 72, to receive metal fastening assemblies 46, and a hollow central volume 74, which is formed, when these housings 70 are secured to the respective planar side or wall portions 34. The metal reinforcing rods 64, preferably made of stainless steel, then serve to add to the overall column strengths of these plastic, knockdown, stackable, bin-pallets 10.

The assembly of these plastic bin-pallets 10, in reference to a cross-sectional view, is illustrated in FIG. 3, as viewed in the direction indicated by the sectional reference lines 3—3 shown in FIG. 1. The interior surfaces are all smooth. The entry corners, via the plastic design and the manufacturing processes, are not sharp.

As shown in FIG. 1, the exterior surface structures of the plastic side components 24, 26 may be formed with vertical ridges 76 and valleys 78 to add cross-sectional strength in compression, while still conserving plastic materials. Preferably, each side component 24, 26, will have a small smooth exterior structure 80, presenting a smooth space to receive data directly by a marking implement, or by receiving a card with data written on it.

As illustrated in FIG. 5, the plastic base components 14 are conveniently stacked, when not in use and being stored, or shipped, or not being used to hold several of the plastic side male or female components 24, 26.

Preferable Major Dimensions of the Plastic Knockdown, Stackable, Bin-Pallet

The preferable major dimensions of this plastic knockdown, stackable bin-pallet 10 are: forty seven inches long; twenty two inches high; and forty seven inches wide.

Other Possible Changes

The preferred embodiment of this plastic knockdown stackable bin-pallet 10 as illustrated, is preferably specifically designed to be received as a substitute for the wood bin-pallets now in use. The handling, transporting and storage procedures and arrangements now in use with respect to wood bin-pallets will be continued. However, the users of these plastic, knockdown, stackable, bin-pallets have the advantages of gaining all of the benefits previously referred to.

The preferred embodiment, after the initial manufacture thereof, involves only the five major components, which are readily assembled and disassembled, without using tools and/or fasteners.

It is possible in keeping with these objectives, or slightly withdrawing from one or more of them, that other embodiments might be decided upon. For example, the reinforcements serving to receive the tongues of a fork lift might be designed as a separate unit. This would be considered, if the bins or some of the bins were to be handled without using forklifts. By way of another example, the provisions for metal reinforcements might be bypassed, if stacking was not contemplated. Also the eight corner plastic corner post structures, might at the outset be formed as the four corner columns, requiring different prefastening arrangements, and different assembly procedures. Also the convenience of storing several side components across a base component could be eliminated. In addition the centered reinforcing rod assemblies could be eliminated. Moreover, the interfitting of the side wall components and the corner post or column structures, via the full length receiving grooves, located at right angles, could be eliminated.

All these changes, used singly or together, could create other embodiments. However, the illustrated embodiment is considered to be the best to meet all the objectives in supplying plastic, knockdown stackable, bin-pallets to industries, especially such as those food industries concerning the providing of fruit, vegetables, fish, and other foods.

We claim:

1. A five major component plastic, knockdown, stackable, bin-pallet for loading, transporting, and storing fruits, vegetables, fish or other foods, which after the initial manufacture thereof is easily assembled and disassembled without using tools and fasteners, and when assembled, being handled by a forklift and being stackable, while protecting the fruits, vegetables, or fish which are loaded therein, and when unloaded and preferably disassembled, being easily cleaned and consolidated for convenient storage and transportation, comprising:

a. a base component having female receiving structures spaced about the sides thereof;

b. two side female components having: male depending structures spaced to enter some of the female receiving structures spaced about the sides of the base component; lower partial corner structures; and vertical receiving hole structures in each of the lower partial corner structures; and c. two side male components having: male depending structures spaced to enter some of the female receiving structures spaced about the sides of the base component; upper partial corner structures; vertical receiving hole structures in each of the upper partial corner structures; and depending rods securely fitted, in part of their length up into the vertical receiving hole structures of these two side male components, and extending below for subsequent removable entry, upon assembly of the plastic bin, into the respective vertical receiving hole structures in each of the lower partial corner structures of the two side female components.

d. eight plastic corner post structures, each being one half the height of the respective female and male side components, each having a central receiving hole to receive and position portions of a metal reinforcing rod;

e. four metal reinforcing rods for positioning, in part of their length, into a respective central receiving hole of a respective plastic corner post structure;

f. metal fastening assemblies used, during the manufacturing of this plastic bin-pallet, to selectively position two of the plastic corner post structures to each plastic side component so upon assembly of this plastic knockdown bin-pallet, the eight plastic corner post structures become four respective corner columns; and whereby, each selected one of the four metal reinforcing rods is optionally and preferably inserted, throughout one half of its length during the initial manufacture, up into a central receiving hole of one of four of the eight plastic corner post structures, optionally and preferably secured by selected metal fastening assemblies to a respective plastic side component, at a respective top side portion thereof, and thereafter, when the other three metal reinforcing rods are so inserted in three more corner post structures likewise secured by using metal fasteners, then these two plastic side components, become the initially manufactured completed two plastic male side wall assemblies of this plastic bin-pallet; and whereby, when each one of the four remaining plastic corner post structures are optionally and preferably secured by selected metal fastener assemblies to a respective plastic side component, at a respective lower side position thereof, then these two plastic side components, become the initially manufactured completed two plastic female side wall assemblies of this plastic bin-pallet, with each respective central receiving hole of each corner post structure being positioned to receive the previously on-inserted one half length of a respective metal reinforcing rod, to continue the continuity of the reinforcing rod through the depth of each respective corner column, formed, upon assembly, by two corner post structures.

2. A five major component plastic, knockdown, stackable bin, as claimed in claim 1, wherein the base component has additional female receiving structures spaced across the base, to receive male depending structures of the side female components and the side male components, when they are closely spaced together in vertical positions, when bin components are stored awaiting assembly and use.

3. A five major component plastic, knockdown, stackable bin-pallet, as claimed in claim 1, having, in addition, reinforcing rod assemblies vertically centered and secured on each plastic side female component and on each plastic side male component on the exterior sides thereof, comprising a rod housing, fasteners to secure the rod housing to these respective side components preferably during the initial manufacture, and reinforcing rods positioned within each rod housing and extending the full depth of each respective side component.

4. A five major component plastic, knockdown, stackable, bin-pallet, as claimed in claim 1, wherein each of the eight plastic corner post structures have two full length receiving grooves, orientated at right angles to one another, with each one of these receiving grooves being fitted about either a respective top side portion edge thereof, or a respective bottom side portion edge thereof, of respective male and female side components.

5. A five major component plastic, knockdown, stackable, bin, as claimed in claim 1, wherein each lower partial corner structure of each of the two side female components, and each upper partial corner structure of each of the two side male components, have two full length receiving grooves, orientated at right angles to one another, with each one of these receiving grooves being fitted about respective side female component edge thereof, or a respective side male component edge thereof.

6. A five major component plastic, knockdown, stackable, bin-pallet, as claimed in claim 1, wherein each of the two side female components and the two side male components have vents to permit the circulation of air, and especially the exiting of any ethylene gas that may be generated during storage periods of food in this plastic bin.

* * * * *